United States Patent [19]

Audeh et al.

[11] 4,392,947

[45] Jul. 12, 1983

[54] INTEGRATED REFINING PROCESS

[75] Inventors: Costandi A. Audeh, Princeton; Saverio G. Greco, Princeton Junction, both of N.J.

[73] Assignee: Mobil Oil Corporation, New York, N.Y.

[21] Appl. No.: 307,047

[22] Filed: Sep. 30, 1981

[51] Int. Cl.[3] ..... C10G 19/00; C10G 19/02; C10G 19/08; C10G 45/00

[52] U.S. Cl. ..... 208/229; 208/207

[58] Field of Search ..... 208/229, 207

[56] References Cited

U.S. PATENT DOCUMENTS

| | | | |
|---|---|---|---|
| 2,432,301 | 12/1947 | Fetterly | 208/235 |
| 2,464,576 | 3/1949 | Hibbard et al. | 208/229 |
| 2,872,412 | 2/1959 | McNeill et al. . | |
| 2,921,021 | 1/1960 | Urban et al. | 208/229 |
| 2,937,986 | 5/1960 | Lukk | 208/229 |
| 2,988,500 | 6/1961 | Gleim et al. . | |
| 3,038,855 | 6/1962 | Weisang et al. . | |
| 3,130,148 | 4/1964 | Gleim . | |
| 3,148,137 | 9/1964 | Strong . | |
| 3,154,483 | 10/1964 | Urban . | |
| 3,216,927 | 11/1965 | Dresser . | |
| 3,367,861 | 2/1968 | Aldridge et al. . | |
| 3,445,380 | 4/1969 | Urban . | |
| 3,525,683 | 8/1970 | Johnston et al. . | |
| 3,694,350 | 9/1972 | Wennerberg . | |
| 3,849,536 | 11/1974 | Morgan . | |
| 4,070,271 | 1/1978 | Urban et al. | 208/206 |
| 4,098,681 | 4/1978 | Carlson . | |
| 4,121,998 | 10/1978 | Frame . | |
| 4,124,531 | 11/1978 | Frame . | |

FOREIGN PATENT DOCUMENTS

| | | | |
|---|---|---|---|
| 505300 | 8/1954 | Canada | 208/235 |
| 1102951 | 3/1961 | Fed. Rep. of Germany . | |

*Primary Examiner*—Delbert E. Gantz
*Assistant Examiner*—Helane E. Maull
*Attorney, Agent, or Firm*—Charles A. Huggett; Michael G. Gilman; Charles J. Speciale

[57] ABSTRACT

An integrated method for refining a hydrocarbon distillate fraction such as kerosene which has sulfur-containing compounds by washing the fraction with an alkaline solution and then sweetening the resulting distillate by treating it with a phthalocyanine catalyst in the presence of a second alkaline solution and oxygen while simultaneously disposing of the spent caustic from the washing by incinerating same in the presence of a sulfur-containing fuel and oxygen to yield harmless sulfates.

12 Claims, 1 Drawing Figure

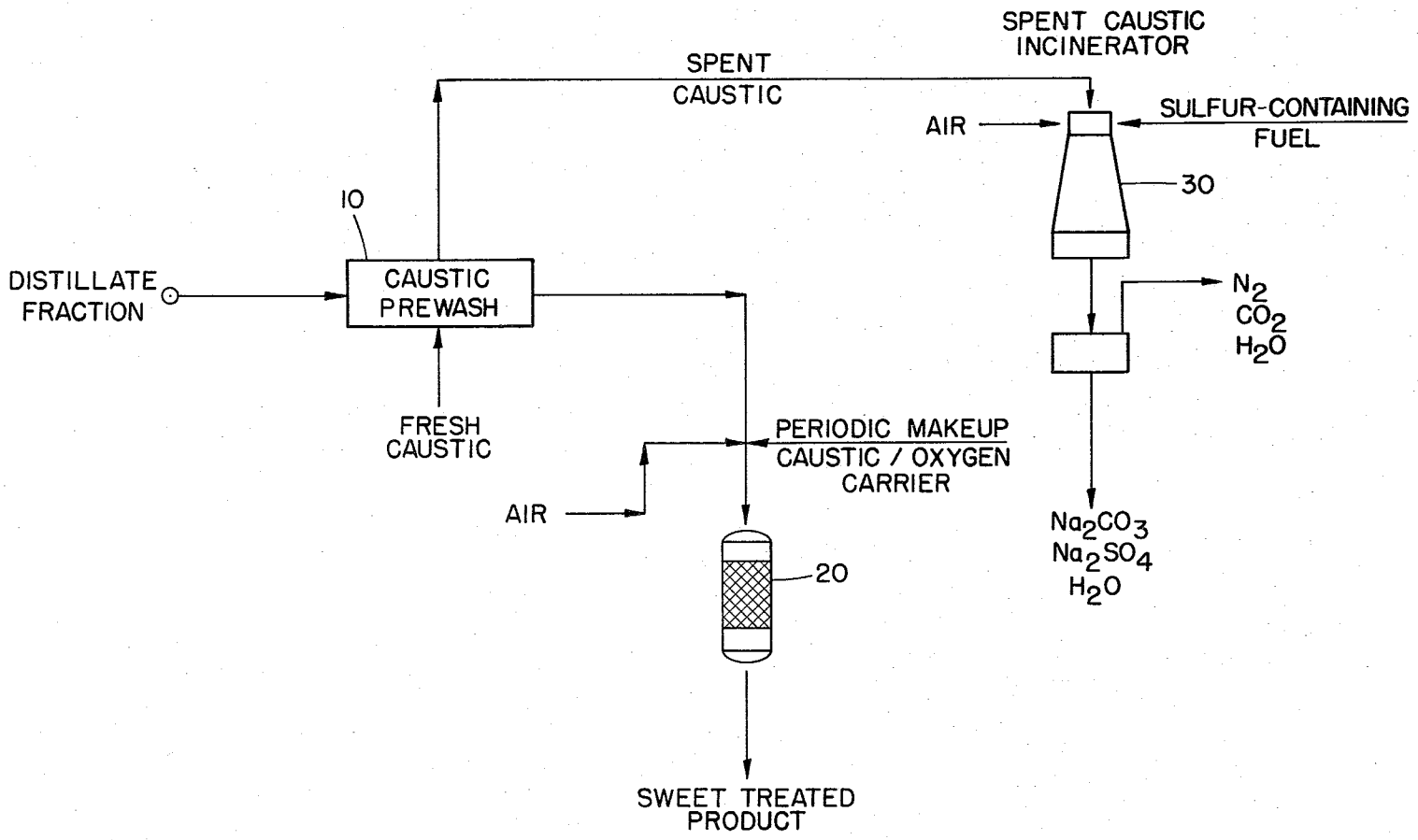
SPENT CAUSTIC INCINERATOR
SULFUR-CONTAINING FUEL
30
AIR
$N_2$
$CO_2$
$H_2O$
$Na_2CO_3$
$Na_2SO_4$
$H_2O$
SPENT CAUSTIC
PERIODIC MAKEUP
CAUSTIC / OXYGEN CARRIER
20
SWEET TREATED PRODUCT
AIR
CAUSTIC PREWASH
FRESH CAUSTIC
10
DISTILLATE FRACTION

INTEGRATED REFINING PROCESS

The present invention relates to the art of petroleum processing and, in particular, to the refining of sour hydrocarbon distillates such as kerosene to reduce the amount of the sulfur-containing compounds.

Crude oils are exceedingly complex mixtures, consisting predominantly of hydrocarbons and containing sulfur, nitrogen, oxygen, and metals as minor constituents. While it is desirable to recover the hydrocarbon constituents in their pure form, realistically it is very difficult to isolate pure products because most of the minor constituents occur in combination with carbon and hydrogen. Separation of impurities such as those listed above generally requires expenditures of valuable resources such as time, chemicals, energy, and money. Therefore, it is the constant goal of the petroleum processing industry to optimize impurity-removal procedures, equipment, and resources in order to eliminate those impurities which have the most degrading effect on the end products.

Perhaps the most ubiguitous impurity encountered in petroleum processing is sulfur. The presence of sulfur in petroleum products and, indeed, in the crude feedstock itself generally increases the corrosive characteristics thereof, and forms harmful and noxious reaction products upon combustion. In particular, the presence of sulfur-containing compounds reduces the combustion characteristics of gasoline and may render fuel oil unusuable in many places due to local regulation on the amount of sulfur allowed therein. Consequently, at nearly every stage of production measures are taken to either reduce the amount of sulfur or to render the sulfur-containing compounds inoffensive.

One method for removing sulfur-containing compounds—hydrogen treating of petroleum fractions—has been known since the 1930's. However, it was not until the advent of catalytic reforming, which made inexpensive hydrogen-rich off-gas available, that hydrogen desulfurization developed to commercial level. Presently, hydrogen desulfurization is primarily associated with a catalytic reaction using cobalt molybdate on an alumina carrier. The feedstock is mixed with recycle and make-up hydrogen and heated to 400°-850° F., then charged to a fixed bed reactor at 50-1,500 psig.

Hydrogen treating is now used extensively to prepare reformer feedstock and, to some extent, for catalytic cracking feedstock preparation. It may also be used to upgrade middle distillates, cracked fractions, lube oils, gasolines and waxes. Hydrodesulfurization, however, is a high energy-consuming process which also requires a supply of hydrogen.

In other attempts to remove and/or render innocuous the sulfur-containing compounds, especially mercapto compounds, i.e. RSH, a method of treating petroleum fractions having a boiling point between about 200° and 700° F., has been devised to "sweeten" these fractions by oxidizing the mercapto compounds to disulfides, e.g., RSSR. This method of rendering mercapto compounds less noxious and noncorrosive may be used for the treatment of any hydrocarbon fraction, but it has been found particularly useful for the treatment of hydrocarbon distillates heavier than gasoline, including kerosene, solvent, stove oil, range oil, burner oil, gas oil, fuel oil, etc.

Various sweetening processes have been developed over the years to include treatment of the hydrocarbon distillate with a doctor solution (e.g. sodium plumbite) and sulfur, reacting the mercapto compounds with copper chloride and the Hypochlorite process. Perhaps the most effective sweetening process to date involves reacting mercapto compounds contained in the distillate fraction (i.e. mercaptans, thiophenols, and salts thereof) with an oxidizing agent, e.g. an oxygen containing gas such as air, and an alkaline reagent in contact with a pthalocyanine catalyst, such as cobalt phthalocyanine. Typically, a phthalocyanine-catalyzed sweetening process includes a fixed bed of a composite of a metallic phthalocyanine with an activated carbon material.

In most cases, this catalyst is found to be very effective and extremely stable—especially in the oxidation of comparatively low molecular weight mercapto compounds and those of primary and secondary configurations. Some difficulty is, however, experienced when this catalyst is used for the treatment of sour distillates containing high molecular weight mercapto compounds. This difficulty is, at least in part, due to the presence of aliphatic and napthenic acids, and phenolic materials, in these sour distillates. It appears that in the presence of an alkaline reagent, these acidic materials (or salts thereof) are attracted to the surface of the phthalocyanine catalyst where they constitute a barrier to the approach of mercaptide anions, which is believed to be an essential step in the chemistry of the over-all oxidation reaction. In addition, these materials interfere with the formation of the mercaptide anions—apparently, by collecting at the interface between the hydrocarbon phase and the alkaline phase in the conversion zone.

In order to eliminate or at least reduce the problem of catalyst deactivation, pretreatment procedures have been developed by which the deactivating materials can be removed from distillate fraction prior to contacting it with the phthalocyanine catalyst. In U.S. Pat. No. 3,445,380 to Urban, a method for pretreating sour distillate fraction is described which includes contacting the sour distillate fraction with finely divided alkali metal hydroxide, e.g., sodium and potassium hydroxide, and washing the contacted distillate with a detergent-containing aqueous solution.

The effluent resulting from the separation step of the Urban process is then subjected to a washing step in order to remove salts of the acidic material.

As a result of this two-step sweetening process, a serious problem arise in the continual production of a caustic waste stream which is quite harmful to organic tissue and cannot be added to a petroleum processing refinery effluent which eventually is introduced into waterways, rivers, subterranean water formations and, in many places, the oceans and surrounding seas.

Included within the spent caustic waste stream are phenolic compounds, thiophenols, naphthenic acids, and any residual mercaptans that form soluble and easily removable sodium mercaptide. In order to deal with the problem expensive processes must be employed to render the harmful caustic innocuous.

It is, therefore, an object of the present invention to eliminate the need for expensive hydrodesulfurization and to overcome the problems associated with refining sour distillate fractions by treatment of the mercapto compounds contained therein.

SUMMARY OF THE INVENTION

The present invention provides a means for treating petroleum distillate fractions to reduce the content of corrosive sulfur compounds as well as the total sulfur content in order to yield quality petroleum fractions without the use of hydrogen pressure and the expensive solid bed of catalyst associated therewith. By the process disclosed herein a distillate fraction having an initial boiling point of from about 200° F. to about 700° F., and preferably from 300° F. to about 450° F., is washed with an aqueous alkaline metal hydroxide solution and then subjected to treatment with a phthalocyanine catalyst in the presence of an alkaline solution and an oxidizing agent, such as an oxygen-containing gas, to oxidize the mercaptan content of the fraction. The waste effluent resulting from the alkaline wash pretreatment and the oxygen-containing gas of the oxidizing step are directed to an incinerator, which is an integral part of the process, wherein a sulfur-containing fuel such as hydrogen sulfide, e.g., $H_2S$, has been provided in an amount sufficient to form innocuous products, such $Na_2SO_4$, from the salts of the napthenic acids and phenolic compounds. Optionally, the sulfur-containing fuel could also be sulfur-containing fuel oil, dialkylsulfides, dialkyldisulfide/naphtha individually or in any combination.

By means of this invention, the stream of potentially hazardous spent caustic is rendered innocuous by conversion of the harmful ingredients to harmless alkaline metal sulfate. Additionally, a means of disposing of undesireable sulfur-containing effluents and/or fractions is provided by the present process.

Furthermore, a unique feature of this invention is its ability to neutralize naphthenic acid salts which are normally difficult to incinerate because of the high temperature required.

BRIEF DESCRIPTION OF THE DRAWING

The drawing is a schematic representation of the process of the present invention.

DETAILED DESCRIPTION OF THE INVENTION

Referring to the drawing a distillate fraction which contains mercapto compounds is introduced to a caustic pretreatment designated generally as prewash vessel 10 into which a sufficient amount of fresh caustic is fed to effect washing of the fraction to remove phenolic compounds, thiophenols, naphthenic acids and any residual mercaptans that form soluble and easily removable sodium mercaptide. In a specific embodiment of the invention it is contemplated that the distillate fraction is kerosene which generally has an initial boiling point of between about 300° F. and 450° F. and a final boiling point of between 475° F. and 550° F. for pretreatment by caustic washing a 3–5% aqueous sodium hydroxide solution is used to remove the unwanted ingredients.

In general, the method of contacting the alkali with the distillate is not of critical importance. In one method, the sour distillate and the finely divided alkali metal hydroxide are placed in the vessel 10 provided with a suitable agitation mechanism and the treating step is carried out in a batch-type operation. In another method, the finely divided alkali is passed to the top of a treating column, simply represented by vessel 10, and counter-currently contacted with an ascending stream of the sour distillate. In yet another method, the finely divided alkali metal hydroxide can be suspended or entrained in a portion of the distillate to be treated or in a suitable organic liquid that is readily separatable from the treated distillate, and the resultant slurry contacted with the distillate to be treated in a suitable contacting zone. Other methods involve possible combinations and permutations of the above methods, as will be readily recognized by those skilled in the art. It is also to be noted that the scope of the present invention includes multiple solid alkali treating steps, which may be advantageously employed in some instance. After washing the hydrocarbon layer or portion it is then sent to the second refining step of the process by, for instance, pumping.

The second step of the refining process involves oxidation of the mercapto compounds by contacting the prewashed fraction with a phthalocyanine catalyst in a "sweetening" step represented by reactor chamber 20.

Any suitable phthalocyanine catalyst may be used in the sweetening step and preferably comprises a metal phthalocyanine. Particularly preferred metal phthalocyanines include cobalt phthalocyanine and vanadium phthalocyanine. Other metal phthalocyanines include iron phthalocyanine, copper phthalocyanine, nickel phthalocyanine, chromium phthalocyanine, etc. These metal phthalocyanines, in general, are not readily soluble in aqueous solvents, and, therefore, for use in an aqueous alkaline solution or for ease of compositing with a solid carrier, a derivative of the phthalocyanine is preferred. A particularly preferred derivative is the sulfonated derivative. Thus, an especially preferred phthalocyanine catalyst is cobalt phthalocyanine sodium sulfonate. Such a catalyst comprises cobalt phthalocyanine disulfonate and also contains cobalt phthalocyanine monosulfonate. Another preferred catalyst comprises vanadium phthalocyanine sulfonate. These compounds may be obtained from any source or prepared in any suitable manner as, for example, by reacting cobalt vanadium phthalocyanine with 25–50% fuming sulfuric acid. While the sulfonic acid derivative is preferred, it is understood that other suitable polar derivatives may be employed. Other derivatives include particularly the carboxylated derivative which may be prepared, for example, by the action of trichloroacetic acid on the metal phthalocyanine or by the action of phosgene and aluminum chloride. In the latter reaction the acid chloride is formed and may be converted to the desired carboxylated derivative by conventional hydrolysis.

This phthalocyanine catalyst may be utilized either as a suspension or solution in a suitable alkaline solution or as a fixed bed in a conversion zone. When used as a solution, the catalyst is preferably used in amounts below about 1% by weight of the alkaline solution. Excellent results have been obtained using about 5 ppm to about 1000 ppm based on the weight of the alkaline solution.

In a preferred embodiment the catalyst is employed as a fixed bed in the conversion zone and, accordingly, the catalyst is prepared as a composite with a solid support. Any suitable support may be employed and preferably comprises activated charcoal, coke or other suitable forms of carbon. In some cases, the support may comprise silica, alumina, magnesia, etc., or mixtures thereof. The solid catalyst is prepared in any suitable manner. In one method, preformed particles of the solid support are soaked in a solution containing the phthalocyanine catalyst, after which excess solution is drained off and the catalyst is used as such, or is subjected to a drying treatment such as mild heating, blowing with air, hydrogen, nitrogen, etc., or successive treatments using two or more of these treatments prior to use in the oxidation. In other methods of preparing the solid composite, solution of the phthalocyanine catalyst may be sprayed or poured over the particles of the solid support, or such particles may be dipped, suspended, immersed or otherwise contacted with the catalyst solution. The concentration of phthalocyanine catalyst in the composite may range from 0.05% to 10% by weight or more of the composite, with a preferred value of about 0.01% to about 1.0%.

According to the present invention, the sweetening is effected in the presence of an alkaline solution. A preferred alkaline reagent comprises sodium hydroxide or potassium hydroxide. Other alkaline solutions include lithium hydroxide, rubidium hydroxide, cesium hydroxide, etc. although in general, these hydroxides are more expensive and therefore are not preferred for commercial use. Preferred alkaline solutions are about 1% to about 50%, by weight concentration of sodium hydroxide or potassium hydroxide preferably in water, or any other suitable solvent.

As hereinbefore set forth, sweetening of the treated sour hydrocarbon distillate is effected by oxidation of mercapto compounds. Accordingly, an oxidizing agent is used in the process. Oxygen is particularly preferred. Air or other oxygen containing gases may be advantageously used. Oxygen is preferably utilized in at least the stoichiometric amount necessary to oxidize the mercapto compounds.

Oxidation of the mercapto compounds in the treated hydrocarbon distillate is effected in any suitable manner. In general, the oxidation is effected at temperatures of ambient to about 200° F., when operating at atmospheric pressure, or when desired, a higher temperature which ranges up to about 400° F., or more when operating at superatmospheric pressure. Atmospheric or superatmospheric pressure which may range up to about 1000 pounds or more may be utilized: however, it is preferred to utilize a pressure which insures that sufficient oxygen is dissolved in the hydrocarbon distillate being treated and this generally encompasses a pressure of about 50 psig to about 150 psig.

The time of contact between the reactants with the catalyst in the conversion zone can generally be adjusted to produce the desired level of mercapto compound oxidation and may range within wide limits depending on the nature and concentration of mercapto compounds, the viscosity and temperature of the distillate, the accumulated life of the catalyst, and the like. In general, this is not a critical parameter and may be selected from a wide range of about minutes to one hour or more with a preferred value of about 5 to about 30 minutes.

In a preferred embodiment, the catalyst is disposed as a fixed bed in a conversion zone and the sour hydrocarbon distillate, oxygen, and the alkaline solution are passed, at the desired temperature and pressure into contact with the catalyst in either upward, downward, or radial flow. The reaction mixture from the contacting zone is passed into a separating zone. Here excess air is directed away from the sweetening step for use in the integrated disposal system. After separation, the distillate, e.g., kerosene, is sent to a drying stage (not depicted herein) and the alkaline/catalyst is mixed with air and sent to an oxidizer where make-up oxidation catalyst and alkaline solution are introduced.

Simultaneously with the progress of the distillate fraction the position of the aqueous alkaline solution from the pretreatment wash which cannot be recycled is directed away from the continuous distillate refining and is sent to an incinerator which is integral to the overall sweetening process. This portion of used alkaline contains salts of phenolic compounds, napthenic compounds, and residual mercaptans and consequently cannot be disposed of by introduction into a natural waterway.

Instead the spent caustic solution is introduced into an incinerator 30 which operates based on the principle that an alkaline compound is capable of reacting with a sulfur-containing fuel in the presence of oxygen to form a harmless sulfate. See U.S. patent applications Ser. No. 238,309 filed Feb. 26, 1981 now U.S. Pat. No. 4,347,225 and Ser. No. 239,922 filed Mar. 3, 1981, now U.S. Pat. No. 4,347,226 which have the same inventive entity and assignee as the present application. The fuel used to support the combustion reaction may be hydrogen sulfide gas, $H_2S$, which may be derived from hydrodesulfurization processes. Pure $H_2S$ is not required but rather various $H_2S$ containing refinery streams can be used. This form of the process is especially attractive since the combustion of gas is easier than the combustion of a liquid sulfur-containing fuel, such as fuel oil.

The essential features of the combustion process are shown in the equation below in which sodium propionate and $H_2S$ are used as examples of spent caustic and sulfur-containing fuel:

$$2CH_3CH_2COO^-Na^+ + H_2S + 9O_2 \rightarrow Na_2SO_4 + 6CO_2 + 6H_2O$$

Other sulfur-containing fuels such as sulfur-containing fuel oil may also be used, alone or to augment $H_2S$ gas with similar results. This option becomes particularly attractive when the crude stock is exceptionally sour (i.e. high in sulfur content) thereby requiring extensive hydrodesulfurization to obtain a fuel oil which is saleable in those parts of the country that require the use of a relatively sulfur-free fuel oil for industrial and domestic heating. Hydrodesulfurization, however, is an energy intensive process that requires a constant supply of hydrogen. Instead of processing the fuel oil fraction to the extent required to eliminate nearly all the sulfur-containing compounds found therein, it may well be discovered upon cost analysis that a savings would be realized by burning the high-sulfur-content fuel oil in the process described by the present invention to render the caustic effluents harmless.

As seen from the equation, a final reaction component necessary for the conversion of waste caustic to the innocuous sulfate is oxygen. Conveniently, this reaction component is easily provided by the excess air used in the oxidation reaction of the "sweetening" step. In this way the refining process of this invention is an entirely integrated system providing a means of disposing of its own caustic waste product similarly utilizing reaction components generated and/or derived from the refining steps.

While there have been described what are believed to be the preferred embodiments of the invention, those skilled in the art will realize that changes and modifications may be made thereto without departing from the spirit of the invention, and it is intended to claim all such changes and modifications as fall within the true scope of the invention.

What is claimed is:

1. A method for refining a hydrocarbon distillate fraction having sulfur-containing compounds comprising:

washing said distillate fraction with a first aqueous alkaline solution to remove acidic materials and mercaptans that form soluble and easily removable alkaline metal mercaptides;

treating the distillate fraction resulting from said washing with a phthalocyanine catalyst in the presence of a second aqueous alkaline solution and oxygen so that the mercapto compounds contained in said fraction are oxidized to form innocuous disulfides;

incinerating spent alkaline solution resulting from said washing in the presence of oxygen and introducing a sufficient amount of sulfur-containing gas to convert the alkaline material to the corresponding sulfate.

2. The process of claim 1 wherein said distillate fraction is kerosene and wherein said sulfur-containing gas comprises hydrogen sulfide.

3. The process of claim 1 or 2 wherein said first aqueous alkaline solution is a sodium hydroxide solution.

4. The process of claim 3 wherein said sodium hydroxide is present in said solution in an amount of from 3%–5% by weight.

5. The process of claim 1 or 2 wherein said phthalocyanine catalyst is cobalt phthalocyanine sodium sulfonate.

6. The process of claim 1 or 2 wherein said second alkaline solution is a sodium hydroxide solution.

7. The process of claim 6 wherein said sodium hydroxide is present in said solution in an amount of from 15% to 35% by weight.

8. A method for refining a hydrocarbon distillate fraction having sulfur-containing compounds comprising:

washing said distillate fraction with a first aqueous alkaline solution to remove acidic materials and mercaptans that form soluble and easily removable alkaline metal mercaptides;

treating the distillate fraction resulting from said washing with a metal phthalocyanine catalyst in the presence of a second aqueous alkaline solution and oxygen so that the mercapto compounds contained in said fraction are oxidized to form innocuous disulfides;

incinerating spent alkaline solution resulting from said washing in the presence of oxygen and a sufficient amount of hydrogen sulfide gas to convert the alkaline material to the corresponding sulfate.

9. A method for refining a hydrocarbon distillate fraction having sulfur-containing compounds comprising:

(a) washing said distillate fraction with a first aqueous alkaline solution to remove acidic materials and mercaptans that form soluble and easily removable alkaline metal mercaptides;

(b) treating the distillate fraction resulting from said washing with phthalocyanine metal catalyst in the presence of a second aqueous alkaline solution and oxygen so that the mercapto compounds contained in said fraction are oxidized to form innocuous disulfides;

(c) oxidizing spent alkaline solution from washing step (a) in the presence of excess oxygen from step (b) together with added sulfur-containing fuel to convert the alkaline material to the corresponding sulfate.

10. The method of claim 9 wherein the spent alkaline solution from step (a) includes naphthenic acid salt.

11. The process of claim 8 wherein said hydrogen sulfide comprises a component of a refinery off-gas.

12. The process of claim 9 wherein said sulfur-containing fuel further comprises sulfur-containing fuel oil.

* * * * *